US009414173B1

(12) United States Patent
Hou

(10) Patent No.: US 9,414,173 B1
(45) Date of Patent: Aug. 9, 2016

(54) FITTING VERIFICATION WITH IN SITU HEARING TEST

(71) Applicant: OTOTRONIX LLC, Houston, TX (US)

(72) Inventor: Zezhang Hou, Cupertino, CA (US)

(73) Assignee: Ototronix, LLC, Houston, TX (US)

( * ) Notice: Subject to any disclaimer, the term of this patent is extended or adjusted under 35 U.S.C. 154(b) by 226 days.

(21) Appl. No.: 14/160,657

(22) Filed: Jan. 22, 2014

Related U.S. Application Data

(60) Provisional application No. 61/849,120, filed on Jan. 22, 2013.

(51) Int. Cl.
*H04R 29/00* (2006.01)
*H04R 25/00* (2006.01)

(52) U.S. Cl.
CPC ..... *H04R 25/70* (2013.01)

(58) Field of Classification Search
CPC ..... H04R 25/70; H04R 25/30; H04R 2225/81
USPC ..... 381/60, 328
See application file for complete search history.

(56) References Cited

U.S. PATENT DOCUMENTS

| | | | |
|---|---|---|---|
| 7,695,441 | B2 | 4/2010 | Harrison et al. |
| 8,308,653 | B2 | 11/2012 | Harrison et al. |
| 2010/0172524 | A1 | 7/2010 | Durant |

FOREIGN PATENT DOCUMENTS

WO WO2010/132100 * 11/2010 ..... G02C 11/06

* cited by examiner

*Primary Examiner* — Paul S Kim
*Assistant Examiner* — Sabrina Diaz
(74) *Attorney, Agent, or Firm* — Marshall & Melhorn, LLC

(57) ABSTRACT

A method for fitting verification of a hearing device has been disclosed. The current invention can be used to evaluate and verify a fitting for a hearing device on individual ears. It uses the hearing device itself as testing apparatus. No additional equipment is required other than the fitting computer and interface which are already required and exist for the device fitting. The method for fitting verification with in situ hearing test consists of at least two steps. One is to obtain patient's unaided hearing thresholds, which can be either in situ hearing thresholds or conventional audiogram. The second step is to measure patient's aided in situ hearing thresholds. An in situ functional gain is then calculated based on the unaided and aided in situ thresholds. The in situ functional gain can be used to evaluate or verify if intended target gains have been achieved with the device.

19 Claims, 2 Drawing Sheets

FITTING VERIFICATION WITH IN SITU HEARING TEST

RELATED APPLICATIONS

This application claims the benefit, under 35 U.S.C.§119 (e) of U.S. Provisional Patent Application Ser. No. 61/849,124 filed on Jan. 22, 2013. Patent Application Ser. No. 61/849,124 is as of the filing date of this application. The contents of Application Ser. No. 61/849,124 are fully incorporated herein by reference.

FIELD OF THE INVENTION

The present invention pertains to fitting verification of hearing devices such as hearing aids and assistive listening devices.

BACKGROUND OF THE INVENTION

A typical fitting of hearing device involve hearing test, calculation of initial device settings based on the results of the hearing test, programming the device with the initial settings, fine tuning the device if necessary, and verifying the fitting with additional measurements. The current invention deals with the verification part of the fitting.

A fitting verification is necessary when the fitting outcome cannot be subjectively measured completely during the fitting session. In such a case, a fitter needs to decide how much gain should be given to a patient based on fitter's professional knowledge about the patient and the hearing device. Once the fitter sets the target gain, he needs to verify that the patient indeed receives the amount intended. The factors that affect the accuracy of the gain received by a patient include patient's ear individual anatomy, accuracy of device modeling, and device variation.

There are a couple of methods for fitting verification. One is the functional gain measurements. The other is the real ear measurements with a probe microphone. The functional gain measurement involves testing patient's hearing thresholds twice at each frequency in the sound field, first without a hearing device to get the unaided thresholds, then with the hearing device the patient is going to use to get the aided thresholds. The function gains are defined as the differences between the unaided and aided thresholds. To get a functional gain measurement, a patient needs to be sat in a booth free of reverberation. The patient's ear must be at certain distance and height in relative to the speaker from which test sounds are produced. If it is desired to test for only one ear, the non-testing ear must be masked or blocked. If these conditions are not controlled carefully, the test result may not be accurate.

The real ear measurement involves measuring sound pressure level at or near the eardrum using a probe microphone. An unaided real ear response is obtained for a patient without wearing a hearing device and an aided real ear response is obtained with the hearing devices in patient's ear. The difference between the aided and unaided real ear responses is real ear insertion gain. The factors that can affect the accuracy of a real ear measurement include the positioning of the probe microphone in relative to the eardrum, the force pinched onto the probe by the insertion of the hearing devices, and the distance and direction between the ear and the speaker from which the test sounds are produced. Acoustic reverberation of the test room/booth may also affect the test consistency. These factors make the test-retest variation of the real ear measurement relatively large. In addition, the equipment for the real ear measurement is expensive and test procedure is cumbersome. As a result, less than 30% of hearing aid dispensing professionals regularly use the method for the fitting verification.

A new method is needed for simpler and more effective fitting verification.

SUMMARY OF THE INVENTION

The current invention is a new method that can be used to evaluate and verify a fitting for a hearing device on individual ears. It uses the hearing device itself as testing apparatus. No additional equipment is required other than the fitting computer and interface which are already required and exist for the device fitting. The fitting computer communicates with the hearing device though the fitting interface and acts to control the operation mode and settings of the device. The communication can be either wired or wireless connection. The test sounds are generated by the device and inserted at the front end of the sound processing and amplification circuit. The test sounds can be pure tone or narrow band noise at various frequencies and levels. They can also be the speech saved in the computer and injected into the device at the front end of the circuit. The test sounds are calibrated in reference to the input to the microphone—so called input referred calibration. The calibration process is well known in the art and beyond the scope of the current invention.

According the current invention, a method for fitting verification with in situ hearing test consists of at least two steps. One is to measure patient's unaided in situ hearing thresholds. The other is to measure patient's aided in situ hearing thresholds. To measure the unaided in situ thresholds, the sound processing and amplification circuit is configured in such that the device would theoretically produce an insertion gain of 0 dB if it operates to process sounds picked up by its microphone. The theoretical insertion gain modeling can be established by the manufacturer of the device based on laboratory tests for the average listeners. The unaided in situ thresholds are obtained by changing the level of test sounds generated by the device and applied at the input of the circuit. To measure the aided in situ thresholds, the circuit gain is set to values to be used by the patient in real life. The aided in situ thresholds are obtained by changing the level of test sounds generated by the device and applied at the input of the circuit. Once the unaided and aided in situ thresholds are obtained, the in situ functional gain can be calculated as the differences between the unaided and aided in situ thresholds. The in situ functional gain can be used to evaluate or verify if intended target gains have been achieved with the device.

The method for administering in situ hearing test can be either a manual procedure or an automated procedure. The manual procedure is well known in the art and is beyond the scope of the current invention. The automated procedure has been described in a separate invention by the current inventor and is also beyond the scope of the current invention.

The method can be implemented as a software program for a computing platform that communicates with the hearing device via a wireless or wired connection. The computing platform can be a computer, smartphone, a tablet computer, or a designated control system for the hearing device. The hearing device can be any type of hearing devices that have a feature for producing in situ sounds at different frequencies and levels. Designing such a hearing device is well known in the art and is beyond the scope of the current invention. The patient's response can be registered via a medium such as a touch screen, push button, keyboard, mouse, or a remote control.

BRIEF DESCRIPTION OF THE DRAWINGS

The above, as well as other advantages of the present invention, will become readily apparent to those skilled in the art from the following detailed description when considered in the light of the accompanying drawings in which.

DETAILED DESCRIPTION OF THE PREFERRED EMBODIMENTS

The invention relates to hearing device fitting. More specifically, it relates to methods for fitting evaluations and verifications. The method can be implemented as a software program in a computing platform such as a computer, smartphone, or a designated control system for a hearing device. The invention will be readily understood by the following detailed description in conjunction with the accompanying drawings which form part of specific embodiments.

Figure 2A:
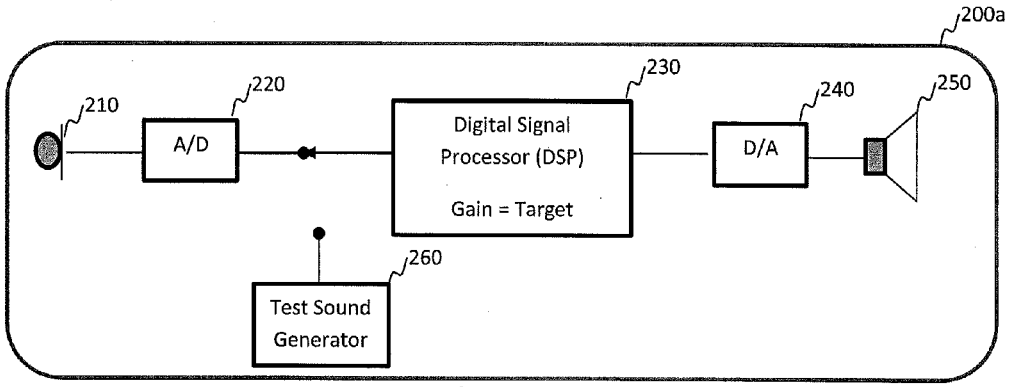
FIG. 2*a* shows a block diagram for a hearing device with in situ hearing test capability under the normal operation mode.
Figure 2B:
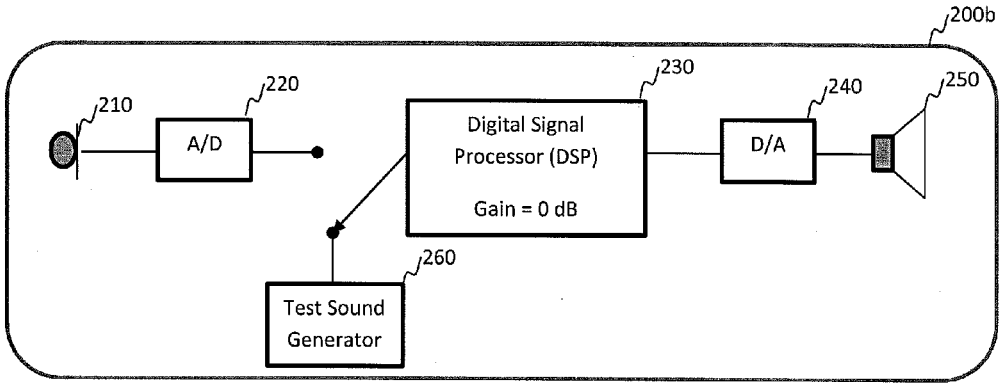
FIG. 2*b* shows a block diagram for a hearing device with in situ hearing test capability under the unaided in situ hearing test operation mode.
Figure 2C:
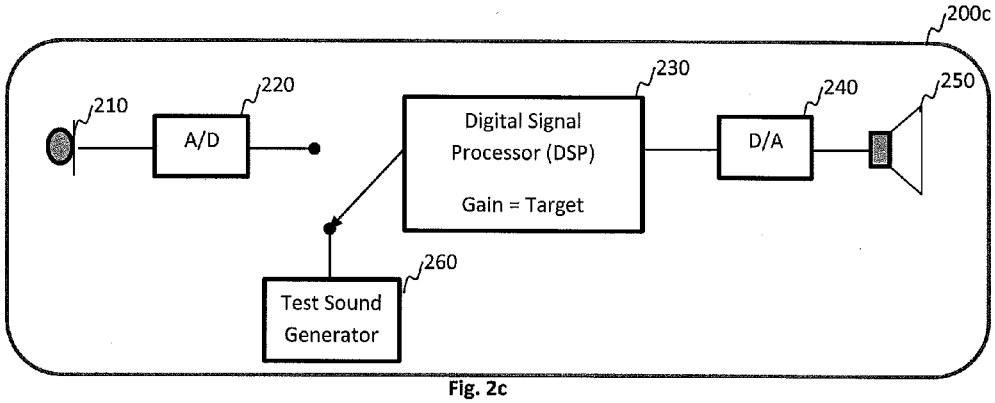
FIG. 2*c* shows a block diagram for a hearing device with in situ hearing test capability under the aided in situ hearing test operation mode.

The standard equipment for fitting a hearing device to a patient includes a computing platform such as a computer or smartphone, a programming interface, and the hearing device itself. Technologies are also available to integrate the programming interface with the computing platform to make it possible for the computing platform to communicate to the hearing device directly. For example, a Bluetooth enabled computer can communicate with a Bluetooth enabled hearing device directly without a separate programming interface. The current invention uses the same equipment to do the fitting verification. The only additional requirement is that the hearing device to be used by the patient in real life is capable of generating in situ test sounds. The hearing device 200 shall be able to operate in two modes: normal mode and in situ test mode, as shown in FIGS. 2*a*, 2*b*, and 2*c*. In the normal operation mode (FIG. 2*a*), the microphone 210 is connected to an A/D converter 220. The output from the A/D converter is fed into the Digital Signal Processor (DSP) 230, whose output is sent to a D/A converter 240 and delivered to a patient's ear through a transducer 250. The DSP 230 is a sound processing and amplification circuit that can includes several signal processing components such as multi-channel wide dynamic compression, noise reduction, feedback cancellation, and directional enhancement, etc. The circuit can be either off the shelf component such as On Semiconductor's Ezario 5900 or Texas Instruments' C54, loaded with special firmware for hearing loss compensation, or a customly designed digital circuit for hearing loss compensation. The gain parameters of the DSP can be adjusted and programmed by the computing platform which communicates with the hearing device via a wired or wireless connection.

In the normal operation mode, the gain settings of the DSP 230 are set to the target gain with which the patient is going to use in real life. The target gain can be a gain calculated from the patient's hearing loss data using a published fitting formula as the NAL (National Acoustic Laboratory), or using a formula provided by the device manufacturer. It can also be a gain that the fitter believes will provide most benefit to the patient based on fitter's professional knowledge about the patient. In the in situ test mode (FIGS. 2*b* & 2*c*), the output from the A/D (220) is not fed into the DSP 230. Instead, the test sounds generated by Test Sound Generator 260 are fed into the DSP, being processed by the DSP and the D/A (240) and presented to the patient's ear via the transducer 250. For the unaided in situ test, the DSP (230) is set to a setting that will allow the device to have a theoretic insertion gain of 0 dB when the device operates in the normal mode (FIG. 2*b*). For the aided in situ test, the DSP (230) is set to the target gain with which the patient is going to use in real life (FIG. 2*c*).

Generally speaking, the fundamental functions and designs of the DSP 230 and Test Sound Generator 260 are well known in the art and beyond the scope of the current invention. The descriptions for FIGS. 2*a*, 2*b*, and 2*c* are set forth to facilitate the detailed description of the current inventions.

Figure 1:
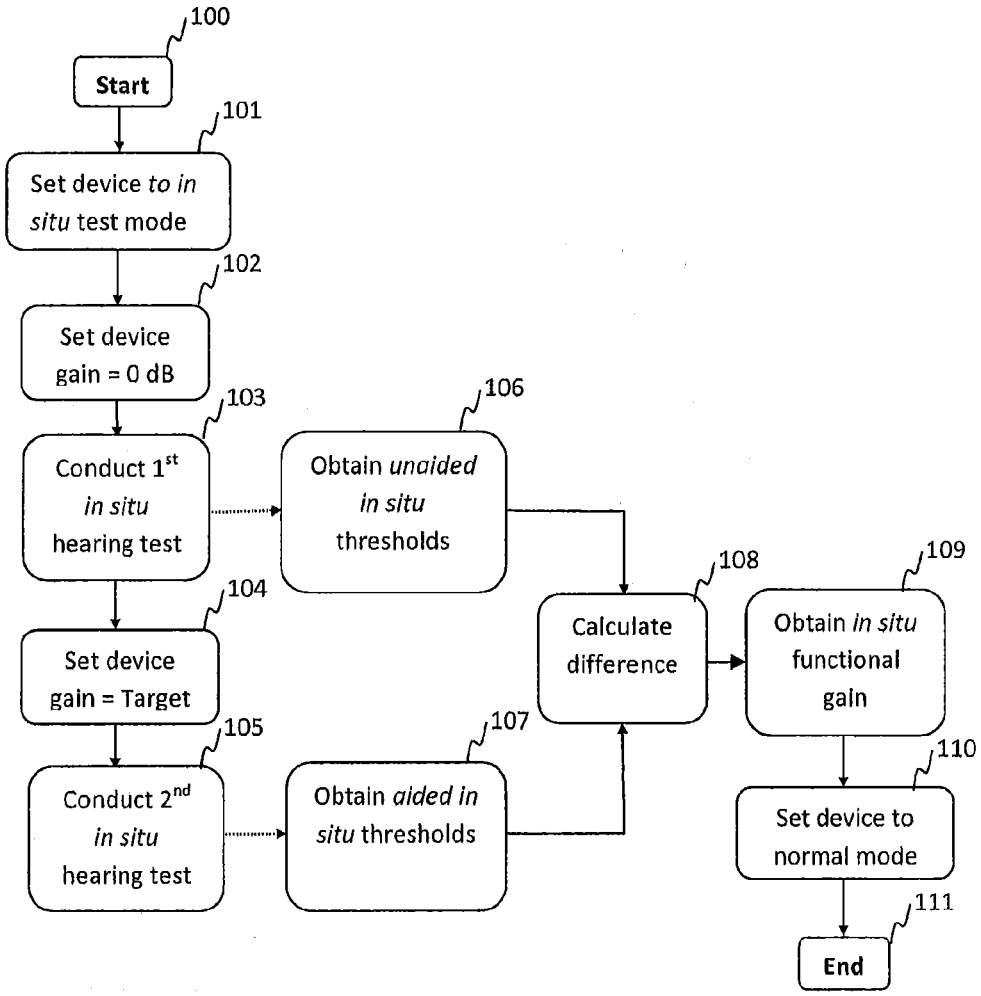
FIG. 1 shows a flowchart for a method for fitting verification with in situ hearing test according to the present invention.

With reference to FIG. 1, according the current invention, a method for in situ fitting verification for a patient using a hearing device to be used by the patient in real life starts at 100. After the method for in situ fitting verification starts at 100, the method operates to set the device to the in situ hearing test mode (201) and set the device gain to 0 dB (102) as illustrated by FIG. 2*b*. Then method operates to conduct the first in situ hearing test (103) to find the unaided in situ thresholds. Generally speaking, an in situ threshold can be found by the following procedure. The test sound is generated in the device and presented to the patient at a pre-determined level. If the patient hears the test sound, its level will be reduced. Otherwise, its level will be increased. The test sound will be presented to the patient again at the new level. This procedure is repeated several times until the test administer believes the in situ threshold has been found, or until a predetermined criterion is met if the procedure is automated. The first in situ hearing test produces the unaided in situ thresholds which are saved at block 106.

After the first in situ hearing test, the methods operates to set device gain to the target gain the patient is going to use in real life (104). The target gain can be a gain calculated from the patient's hearing loss data using a published fitting formula as the NAL (National Acoustic Laboratory), or using a formula provided by the device manufacturer. It can also be a gain that the fitter believes will provide most benefit to the patient based on fitter's professional knowledge about the patient. After setting the device gain to the target gain, the method operates to conduct the second in situ hearing test (105). The procedure for the second in situ hearing test is the same as the first one except that the device gain is different. The second in situ hearing test produces the aided in situ thresholds which are saved at block 107. The difference between the unaided in situ thresholds and aided in situ thresholds are calculated (108) to obtain the in situ functional gains (109). Alternatively, the in situ functional gain can be calculated as the difference between patient's conventional unaided thresholds and the aided in situ thresholds. The conventional unaided threshold can be obtained using a standard audiometer which is available in almost all hearing clinics. The procedure to obtain the conventional unaided thresholds is a standard routine and most fitters are well trained to administer it. After the in situ functional gains are obtained, the method operates to set the device back to its normal operation mode (110) and come to an end (111).

The method can be implemented as a software program for a computing platform that communicates with the hearing device via wireless or a wired connection. The computing platform can be a computer, smartphone, a tablet computer, or a designated control system for the hearing device. The patient's response can be registered via a medium such as a touch screen, push button, keyboard, mouse, or a remote control.

The in situ functional gain obtained with the current invention is similar to the traditional functional gain and can used to evaluate how well the intended target gain has been achieved. The advantage of using the in situ functional gain is that it can be measured without additional equipment. Patients do not have to be moved to a sound approved booth and positioned at certain distance and height in relative to the sound field speaker. Therefore, the test results can be more consistent and reliable.

What is claimed:

1. A method for performing a fitting verification for a hearing device recipient using a hearing device, the method comprising the steps of:

providing the hearing device in communication with a computing device;

performing a first in situ hearing test using the computing device and the hearing device to obtain an unaided in situ threshold level for the hearing device recipient, wherein the hearing device is configured to have an insertion gain of about 0 dB in the normal operation mode;

performing a second in situ hearing test using the computing device and the hearing device to obtain an aided in situ threshold level for the hearing device recipient; and calculating an in situ functional gain for use with verifying a setting of the hearing device using the computing device, wherein the in situ functional gain is based on the unaided in situ threshold level and the aided in situ threshold level.

2. The method for performing a fitting verification according to claim 1, wherein the step of calculating an in situ functional gain for use with verifying a setting of the hearing device is calculated by determining a difference between the unaided in situ threshold level and the aided in situ threshold level.

3. The method for performing a fitting verification according to claim 1, wherein the step of performing the second in situ hearing test is performed with the hearing device configured to have a target gain configured for use by the hearing device recipient.

4. The method for performing a fitting verification according to claim 1, wherein the step of performing the first in situ hearing test is performed using a plurality of test sounds generated in the hearing device.

5. The method for performing a fitting verification according to claim 4, wherein the plurality of test sounds generated in the hearing device are transmitted through a sound processing circuit and a sound amplification circuit of the hearing device.

6. The method for performing a fitting verification according to claim 5, wherein the plurality of test sounds generated in the hearing device are calibrated in reference to an input for a microphone of the hearing device.

7. The method for performing a fitting verification according to claim 1, wherein the step of performing the second in situ hearing test is performed using a plurality of test sounds generated in the hearing device.

8. The method for performing a fitting verification according to claim 7, wherein the plurality of test sounds generated in the hearing device are transmitted through a sound processing circuit and a sound amplification circuit of the hearing device.

9. The method for performing a fitting verification according to claim 8, wherein the plurality of test sounds generated in the hearing device are calibrated in reference to an input for a microphone of the hearing device.

10. A system for performing a fitting verification for a hearing device recipient using a hearing device, the system comprising:

the hearing device; and a computing device in communication with the hearing device and configured to issue a plurality of instructions stored in the computing device, the computing device issuing instructions to:

perform a first in situ hearing test using the hearing device to obtain an unaided in situ threshold level for the hearing device recipient, wherein the hearing device is configured to have an insertion gain of about 0 dB in the normal operation mode;

perform a second in situ hearing test using the hearing device to obtain an aided in situ threshold level for the hearing device recipient; and calculate an in situ functional gain for use with verifying a setting of the hearing device using the computing device, wherein the in situ functional gain is based on the unaided in situ threshold level and the aided in situ threshold level.

11. The system for performing a fitting verification according to claim 10, wherein the in situ functional gain for use with verifying a setting of the hearing device is calculated by determining a difference between the unaided in situ threshold level and the aided in situ threshold level.

12. The system for performing a fitting verification according to claim 10, wherein the second in situ hearing test is performed with the hearing device configured to have a target gain configured for use by the hearing device recipient.

13. The system for performing a fitting verification according to claim 10, wherein the first in situ hearing test is performed using a plurality of test sounds generated in the hearing device.

14. The system for performing a fitting verification according to claim 13, wherein the plurality of test sounds generated in the hearing device are transmitted through a sound processing circuit and a sound amplification circuit of the hearing device.

15. The system for performing a fitting verification according to claim 14, wherein the plurality of test sounds generated in the hearing device are calibrated in reference to an input for a microphone of the hearing device.

16. The system for performing a fitting verification according to claim 10, wherein the second in situ hearing test is performed using a plurality of test sounds generated in the hearing device.

17. The system for performing a fitting verification according to claim 16, wherein the plurality of test sounds generated in the hearing device are transmitted through a sound processing circuit and a sound amplification circuit of the hearing device.

18. The system for performing a fitting verification according to claim 17, wherein the plurality of test sounds generated in the hearing device are calibrated in reference to an input for a microphone of the hearing device.

19. A fitting verification system using a hearing device, comprising:

the hearing device; and a computing device in communication with the hearing device and configured to issue a plurality of instructions stored in the computing device, wherein the computing device issues instructions to:

perform a first in situ hearing test using the hearing device to obtain an unaided in situ threshold level for a hearing device recipient, wherein the hearing device is configured to have an insertion gain of about 0 dB in the normal operation mode;

perform a second in situ hearing test using the hearing device to obtain an aided in situ threshold level for the hearing device recipient; and calculate an in situ functional gain for use with the hearing device, the in situ functional gain is based on the unaided in situ threshold level and the aided in situ threshold level.

* * * * *